US010543889B2

(12) United States Patent
Rezzonico et al.

(10) Patent No.: US 10,543,889 B2
(45) Date of Patent: Jan. 28, 2020

(54) FENDER FOR BOATS CONSISTING OF TWO COMPONENTS MADE OF PVC COUPLED BY A LOCK JOINT

(71) Applicant: TESSILMARE s.r.l., Capiago Intimiano (IT)

(72) Inventors: Margherita Rezzonico, Sirtori (IT); Ranieri Rezzonico, Sirtori (IT)

(73) Assignee: TESSILMARE S.R.L., Capiago Intimiano (IT)

( * ) Notice: Subject to any disclaimer, the term of this patent is extended or adjusted under 35 U.S.C. 154(b) by 0 days.

(21) Appl. No.: 16/002,064

(22) Filed: Jun. 7, 2018

(65) Prior Publication Data

US 2018/0354594 A1 Dec. 13, 2018

(30) Foreign Application Priority Data

Jun. 8, 2017 (IT) ..... 202017000063068
Jul. 4, 2017 (IT) ..... 202017000075029

(51) Int. Cl.
*B63B 59/02* (2006.01)

(52) U.S. Cl.
CPC ..... *B63B 59/02* (2013.01)

(58) Field of Classification Search
CPC ..... B63B 59/02; Y10T 428/24289; Y10T 428/24017; Y10T 428/24008; B60R 13/04
USPC ..... 114/219, 364
See application file for complete search history.

(56) References Cited

U.S. PATENT DOCUMENTS 3,606,432 A * 9/1971 Honatzis ..... B60R 13/04 293/128
4,970,980 A 11/1990 Eisner
5,013,596 A * 5/1991 Kessler ..... E04F 19/026 24/293
7,430,978 B2 10/2008 Rezzonico
8,567,333 B2 * 10/2013 Berman ..... B63B 59/02 114/219
8,839,731 B2 9/2014 Rezzonico
9,073,613 B2 * 7/2015 Berman ..... B63B 59/02
2002/0178684 A1 * 12/2002 Barnett ..... A47B 95/043 52/716.1
2004/0200397 A1 10/2004 Klein
2010/0077953 A1 4/2010 Simard et al.
2016/0355243 A1 * 12/2016 Hynes ..... B63B 59/02

OTHER PUBLICATIONS

Taco Marine 2015 Product Catalog, retrieved from the internet on Jun. 23, 2019, "http://pdf.nauticexpo.com/pdf/taco-marine-inc/taco-marine-product-catalog/21861-93811.html" (Year: 2015).*
Taco Marine 2015 Product Catalog, p. 55, retrieved from the internet on Jun. 23, 2019, "http//pdf.nauticexpo.com/pdf/taco-marine-inc/taco-marine-product-catalog/21861-93811-_55.html" (Year: 2015).*
(Continued)

*Primary Examiner* — Anthony D Wiest
(74) *Attorney, Agent, or Firm* — Jacobson Holman, PLLC

(57) ABSTRACT

A fender for boats consisting of a base made of plastic material able to be fixed to a hull of a boat, and an insert made of plastic material able to be coupled by a lock joint to the base. The insert comprises two wings, two connection protrusions, a central body and two outer grooves between each wing and the respective connection protrusion.

7 Claims, 3 Drawing Sheets

(56) References Cited

OTHER PUBLICATIONS

Taco Marine 2015 Product Catalog, p. 65, retrieved from the internet on Jun. 23, 2019: "http//pdf.nauticexpo.com/pdf/taco-marine-inc/taco-marine-product-catalog/21861-93811-_65.html" (Year: 2015).*

* cited by examiner

FENDER FOR BOATS CONSISTING OF TWO COMPONENTS MADE OF PVC COUPLED BY A LOCK JOINT

BACKGROUND OF THE INVENTION

The present invention relates to a fender for boats consisting of two components made of PVC coupled by lock joint.

The protection of the hull of boats, especially luxury boats, represents a need which is particularly felt in sailing.

During docking maneuvers, even expert navigators touch the berthing structure, which does not always have fenders able to absorb impacts.

PRIOR ART REFERENCES

U.S. Pat. No. 7,430,978 by the present applicant describes a fender for boats consisting of an internal portion with an H-profile for fixing to the hull, and an outer portion coupleable to said inner portion and able to absorb impacts. The inner part is made of rigid PVC, while the outer part is made of soft PVC. Said inner and outer portions are coupled loosely, in other words, the outer portion can also move even after coupling.

The present applicant is also the proprietor of U.S. Pat. No. 8,839,731, which describes a fender for boats comprising a steel laminated profile with an open section consisting of an outer cap connected to the ends with two containing, parallel rectilinear rest stretches, converging towards the center of the cap without meeting, able to rest on the edge of the boat. Said laminated profile is filled internally with a core made of PVC. Said profile comprises holes for fixing to the hull by screws. Said profile is particularly robust, but requires fixing screws, which makes it difficult to associate with the hull and remove. The screws further penalize the esthetics of the product designed above all for luxury boats.

Disadvantageously, while increasing resistance to external impacts, it is difficult to associate the metal profile with the core made of plastic material: a bending of the metal is required fed by a belt.

U.S. Pat. No. 4,970,980 describes a fender for jet skis consisting of a base for connecting to the hull and an outer elastic profile, which is coupled by lock joint by two protrusions to said base. Said outer elastic profile is inflatable.

US-2010/0077953 shows a fender for jet skis comprising an outer profile, which is coupled by lock joint to a base fixed to the hull. Said outer profile has two winged hooking portions of the base, said portions being housed in an internal channel, which is made after the coupling.

US-2004/0200397 shows a fender for boats comprising a base fixed to the hull and an insert coupleable by lock joint to said base by two coupling portions, able to interact with wings of said base.

The last three cited patent documents comprise both the base and the insert made of plastic material, and the insert with two coupling portions.

Disadvantageously, in the coupling step, the problem of bending the insert arises so that the coupling portions of the insert are coupled to wings of the base. Said operation can result in breakage of the insert because the plastic is generally rigid enough to withstand the impacts. It is sufficient for one coupling portion of the insert to crack and the whole insert needs to be replaced.

SUMMARY OF THE INVENTION

It is an object of the present invention to produce a modular fender for boats, with components coupleable by lock joint, made only of plastic material, which is simple to build.

It is a further object of the present invention that said fender is robust, stable and adequately flexible, particularly during the step of assembly.

Advantageously, by penetrating deep into the central body of the insert, the inner groove reduces the mass thereof (and consequently the weight) improving the flexibility of the connection protrusions of the insert.

The outer grooves favor the flexibility of the wings of the insert with respect to the connection protrusions of the insert itself.

The fender consisting of said base and said insert is thus modular and can be able to any curve of the hull of the boat, possibly also a jet ski.

The coupling of the insert to the base is performed simply by a lock joint, without separate fixing means, such as screws, rivets or similar.

Advantageously, the insert can easily be removed for maintenance or replacements.

DESCRIPTION OF THE DRAWINGS

These and other features of the present invention will become clearer from the following detailed description of practical embodiments thereof, illustrated by way of a non-limiting example in the following attached drawings, wherein.

DETAILED DESCRIPTION OF THE INVENTION

A fender 1 for boats consists of a base 2 able to be fixed to a hull of a boat by known fixing means, for example screws, and an insert 3 able to be coupled by a lock joint to said base 2.

Figure 4:
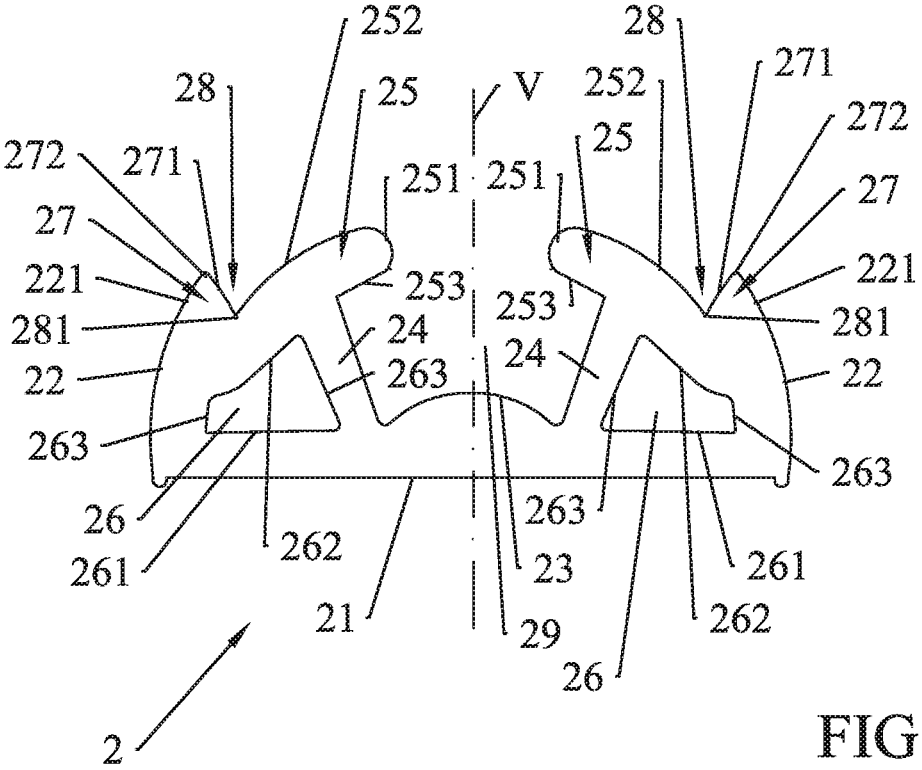
FIG. 4 shows a vertical section view of a connection base of the fender.

As clearly visible by observing FIG. 4 in particular, said base 2 comprises a rectilinear portion 21 able to rest on the hull, two curved lateral portions 22 and a curved central portion 23. Said rectilinear portion 21 is able to bend, thus adapting to the curvature of the hull.

Inclined bands 24 and connection protrusions 25, together with said curved lateral portions 22 and said rectilinear portion 21, define closed lateral cavities 26.

The base 2 comprises an axis of symmetry V, which cuts said rectilinear portion 21 in half.

Each connection protrusion 25, in the section view of FIG. 4, comprises a curved end 251, a rectilinear stretch 253 for connecting to the inclined band 24, and a curved stretch 252, which terminates in a lateral wing 27.

The base 2 comprises two lateral wings 27, each of which is formed by one end 221 of said curved lateral portion 22 and a curved stretch 271, which meet, forming a tip 272, preferably a chamfered tip.

Each connection protrusion 25 and the respective wing 27 determine an open lateral cavity 28, which comprises a lower inflection point 281.

Each cavity 26, in section according to FIG. 4, is delimited by a straight lower stretch 261 and a curved upper stretch 262, which are connected by two straight stretches 263.

Said straight stretches 263 preferably have a different length; said curved upper stretch 262 is convex downwards.

The cavity 26 widens towards the axis V (FIG. 4).

The curved central portion 23, the inclined bands 24 and the connection protrusions 25 form a central open cavity 29.

The base 2 is made of plastic material, for example PVC, flexible and elastic, which makes it easily adaptable to any curve of the hull of the boat.

Figure 3:
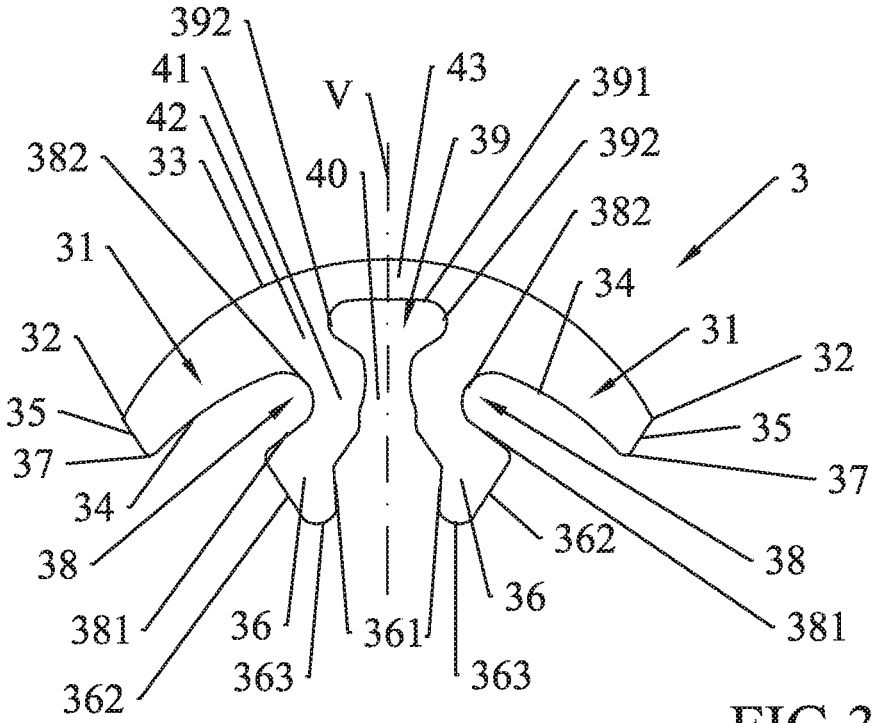
FIG. 3 shows a vertical section view of an insert of the fender.

With particular reference to FIG. 3, the insert 3 comprises two wings 31, two connection protrusions 36 and a central body 42.

The insert 3 is made in a single piece, in plastic material, for example PVC.

The insert 3 comprises an outer buffer edge 33, which terminates in said wings 31 at the side.

Besides the outer edge 33, each wing 31 comprises a curved inner stretch 34 and a straight lateral stretch 35.

The straight lateral stretch 35 is joined to the outer edge 33 by a corner 32, and to the curved inner stretch 34 by a chamfer 37. The curved stretch 34 is internal in the sense that when the insert 3 is coupled to the base 2, it is not exposed to direct impacts.

Figure 1:
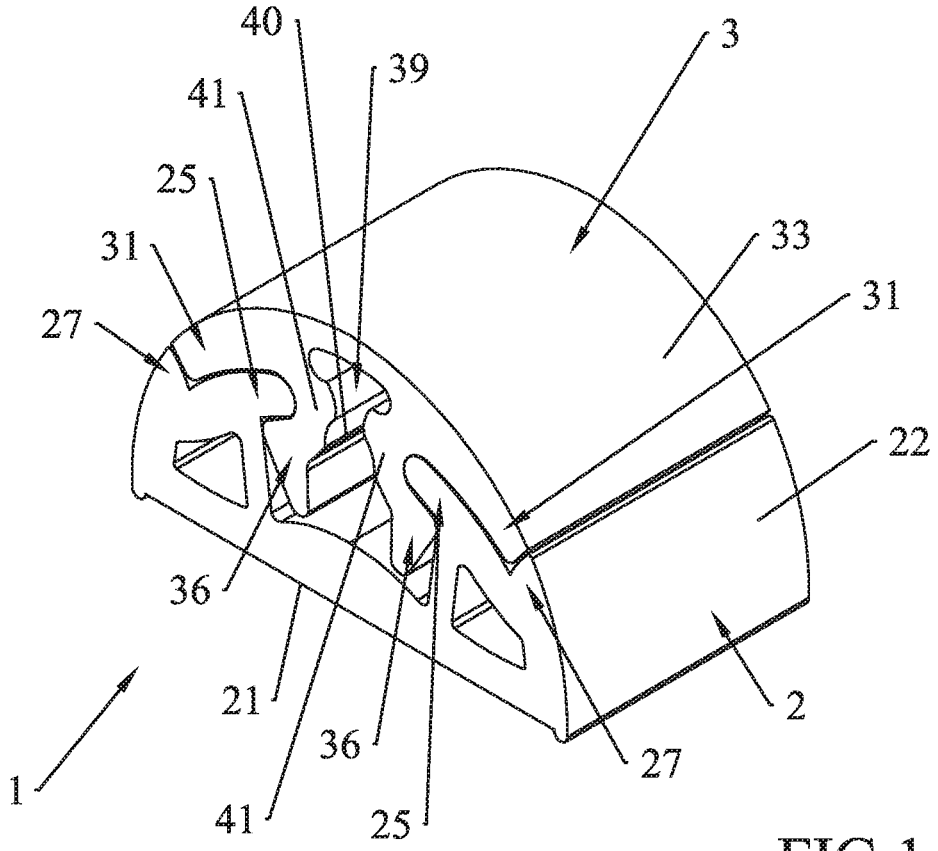
FIG. 1 shows a perspective view of a fender according to the invention.
Figure 2:
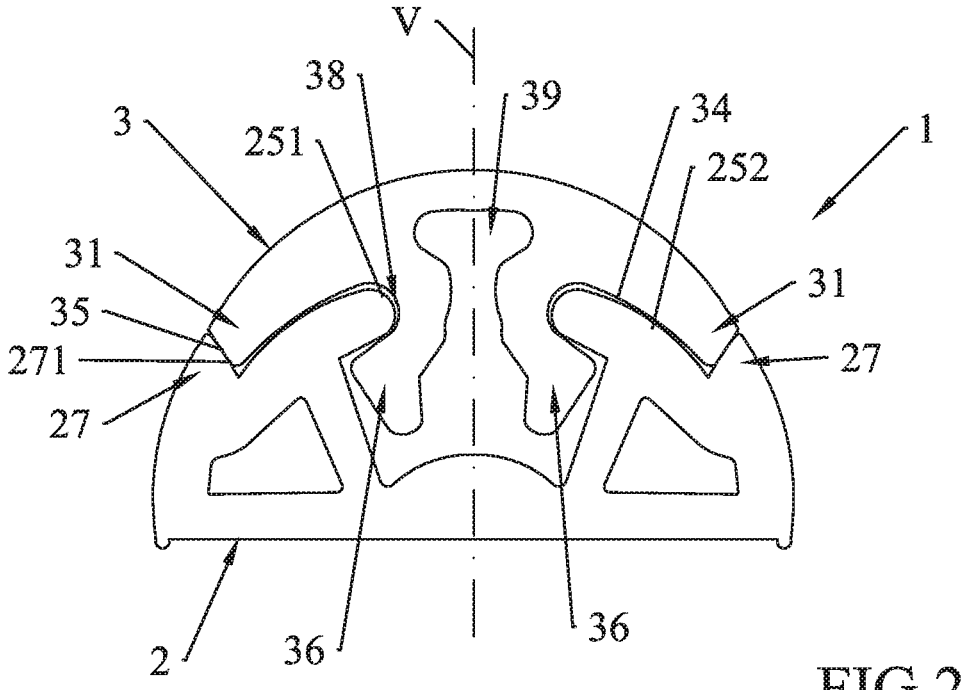
FIG. 2 shows a vertical section view of the fender.

The curved inner stretches 34 converge towards the same axis of symmetry V of the base 2 as noted in FIG. 2 in which the insert 3 and the base 2 are coupled.

Each connection protrusion 36 is shaped like a "boot" with a rounded tip facing the axis V.

More specifically, each protrusion 36 comprises an inner rectilinear stretch 361 and an outer rectilinear stretch 362, which meet in a connection 363, preferably rounded.

Each outer rectilinear stretch 362 joins the inner curved stretch 34 of the respective wing 31 by outer grooves 38, each of which consists of a straight stretch 381 and a curved stretch 382.

The insert 3 further comprises a wide inner groove 39 placed above the wings 31 and the outer grooves 38, with respect to the axis V.

Said inner groove 39 is open towards the protrusions 36, which determine a central channel 40 with a varying width.

The edges of said central channel 40 and the outer grooves 38 determine legs 41 for connecting the protrusions 36 to the wings 31.

The inner groove 39 penetrates deep into the central body 42 of the insert 3 reducing the mass thereof (and consequently the weight), and improving the flexibility of the protrusions 36 by the connection legs 41.

The thickness of each connection leg 41 is in the same order of size as the width of the central channel 40, thus ensuring a wide fold angle for said legs 41 towards the axis V.

A connecting stretch 43 of the central body 42 is noted above the inner groove 39, having a thickness in the same order of size as the width of the central channel 40, thus favoring the flexibility of the wings 31.

The inner groove 39 comprises a straight upper stretch 391 and lateral curved stretches 392, which converge towards the axis V, thus connecting to the central channel 40.

The inner groove 39 and the central channel 40 substantially form a T cut in half by the axis V.

Figure 5:
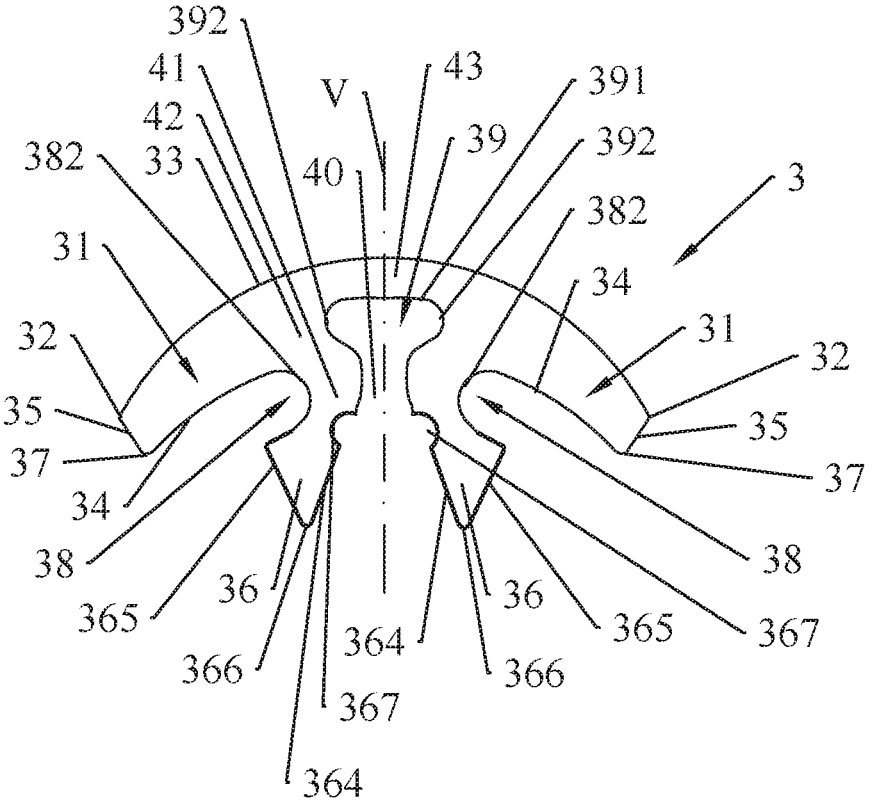
FIG. 5 shows a vertical section view of an insert of the fender according to a second embodiment.

Alternatively (FIG. 5) the two connection protrusions 36 can have a substantially V shape, wherein each protrusion 36 comprises an inner rectilinear stretch 364 and an outer rectilinear stretch 365, which meet in a connection 366, preferably rounded.

In said alternative embodiment, further grooves 367 are provided, able to interrupt said inner rectilinear stretch 364, thus defining constrictions for the protrusions 36 with said outer grooves 38.

The outer grooves 38 favor the flexibility of the wings 31 with respect to the protrusions 36, thus facilitating the coupling with the base 2, which will subsequently become clearer.

In FIG. 2 the insert 3 can be seen coupled by lock joint to the base 2.

The coupling is performed by forcing the insertion of the protrusions 36 of the insert 3 into the cavity 29 of the base 2, so that the curved ends 251 of the protrusions 25 of the base 2 engage with the outer grooves 38 of the insert 3.

In particular, note that the curved inner stretches 34 of the insert 3 and respective curved stretches 252 of the base 2 are coupled to one another.

Advantageously, each straight lateral stretch 35 of the wing 31 is resting on the curved stretch 271 of the respective wing 27 of the base 2.

When the coupling is complete, the cavities 28 of the base 2 are substantially closed by the wings 31 of the insert 2.

The cavities 28 allow an improvement in the deformability of both the wings 27 and the protrusions 25, both in the step of coupling and in the step of absorbing the impacts.

In this latter case, the wing 27 will absorb the deformation of the insert 3, which will press outwards as the wings 31 tend to "open", while the lock joint connection prevents de-coupling.

Advantageously, the resting of the wings 31 of the insert 3 on the wings 27 of the base 2 allows a substantial continuity in the outer edge of the fender 1 to be obtained, partly by the insert 3, in other words, the element most subject to impacts, and partly by the base 2.

The central channel 40, together with the inner groove 39, facilitates the deformability of the protrusions 36 without compromising the soundness of the coupling: it is essential that the inner groove 39 penetrates deep into the central body 40, above the legs 41 of the protrusions 36, and above the wings 31. Thus, the flexibility of both the wings 31 and the protrusions 36 is ensured, independently of one another.

The insert 3 is flexible and of reduced weight.

The base 2 and the core 32, both made of plastic material (for example PVC), are obtained by a procedure of extrusion.

The fender 1 consisting of said base 2 and said insert 3 is thus modular and adaptable to any curve of the hull of the boat, possibly also a jet ski.

The coupling of the insert 3 to the base 2 is performed simply by lock joint, without separate fixing means, such as screws, rivets or similar.

Advantageously, the insert 3 can easily be removed for maintenance or replacements.

The invention claimed is:

1. A fender for boats comprising a base made of plastic material fixed to a hull of a boat, and an insert made of plastic material coupled by a lock joint to the base, the insert comprising two wings, two connection protrusions, a central body and two outer grooves between each wing and the respective connection protrusion, the base comprising two connection protrusions able to be coupled by a lock joint to said connection protrusions of the insert, so that a curved end of each connection protrusion of the base is coupled to the respective outer groove of the insert, wherein the insert further comprises an inner groove placed above the wings and the outer grooves, with respect to an axis of symmetry, the inner groove being open towards the connection protrusions of the insert which form a central channel, edges of the central channel and the outer grooves form connection legs for connecting the connection protrusions to the wings of the insert, the inner groove penetrating deep into the central body of the insert above the connection legs with respect to the axis of symmetry;

wherein the inner groove comprises a straight upper stretch and curved lateral stretches, which converge towards the axis of symmetry thus connecting to the central channel substantially forming a T cut in half by the axis of symmetry.

2. The fender according to claim 1, wherein besides an outer buffer edge, each wing of the insert comprises a curved inner stretch and a straight lateral stretch, each connection protrusion of the base comprises a curved stretch, which terminates in a lateral wing forming a cavity, each lateral wing comprising a curved stretch, after the coupling, each straight lateral stretch of the wing resting on the curved stretch of the respective wing of the base, the cavities of the base being substantially closed by the wings of the insert, thus ensuring a substantial continuity of the outer buffer edge of the insert with the curved lateral portions of the base.

3. The fender according to claim 2, wherein each wing comprises a tip.

4. The fender according to claim 3, wherein the tip is a chamfered tip.

5. The fender according to claim 1, wherein the base comprises a rectilinear portion able to rest on the hull, two curved lateral portions and a curved central portion, the rectilinear portion being able to bend, thus adapting to the curvature of the hull.

6. The fender according to claim 5, wherein the base comprises inclined bands which, together with the connection protrusions, the curved lateral portions and the rectilinear portion, define closed lateral cavities.

7. The fender according to claim 6, wherein the curved central portion, the inclined bands and the connection protrusions form an open central cavity.

* * * * *